US008671502B2

(12) United States Patent
Nazzari

(10) Patent No.: US 8,671,502 B2
(45) Date of Patent: Mar. 18, 2014

(54) SURF WAX COMB AND HOLDER ACCESSORY

(76) Inventor: Ian Nazzari, Moraga, CA (US)

( * ) Notice: Subject to any disclaimer, the term of this patent is extended or adjusted under 35 U.S.C. 154(b) by 814 days.

(21) Appl. No.: 12/786,999

(22) Filed: May 25, 2010

(65) Prior Publication Data

US 2011/0294381 A1 Dec. 1, 2011

(51) Int. Cl.
*A47L 13/02* (2006.01)

(52) U.S. Cl.
USPC ..... 15/236.08; 206/38

(58) Field of Classification Search
USPC ..... 15/235.6, 236.08, 245.1, 257.01, 142; 206/38, 361; 441/74
See application file for complete search history.

(56) References Cited

U.S. PATENT DOCUMENTS

| | | | |
|---|---|---|---|
| 5,127,860 | A | 7/1992 | Kraft |
| 5,219,238 | A | 6/1993 | Hainbach |
| 6,821,041 | B1 | 11/2004 | Hallam et al. |
| 7,418,793 | B2 | 9/2008 | Dominguez et al. |
| 7,588,149 | B2 | 9/2009 | Gelardi |
| 2005/0183981 | A1 | 8/2005 | Gelardi |
| 2005/0278866 | A1 | 12/2005 | Madarieta |
| 2006/0189239 | A1 | 8/2006 | Brauers et al. |
| 2006/0248792 | A1 | 11/2006 | Huxley |
| 2007/0151624 | A1 | 7/2007 | Munz |
| 2007/0271971 | A1 | 11/2007 | Johnson |
| 2007/0277336 | A1 * | 12/2007 | Heaslet ..... 15/105 |
| 2008/0110052 | A1 | 5/2008 | Ritter et al. |
| 2008/0290109 | A1 | 11/2008 | Williams |

FOREIGN PATENT DOCUMENTS

| | | | |
|---|---|---|---|
| KR | 1020050057665 | A | 6/2005 |
| WO | 2009058132 | A1 | 5/2009 |

OTHER PUBLICATIONS

International Search Report and Written Opinion issued in PCT/US2011/000824, Jan. 6, 2012, 10 pages.

Internet Advertisement: Mr. Zogs Container & Wax Comb. Viewed on Apr. 30, 2010 at http://www.tactics.com/mr-zogs/container-wax-comb.

Internet Advertisement: Sticky Bumps Wax Kit Viewed on Sep. 17, 2009 at http://www.mikes-diving.co.uk/sticky-bumps---surf-was--comb-kit-538-p.asp.

* cited by examiner

*Primary Examiner* — Rachel Steitz
(74) *Attorney, Agent, or Firm* — Workman Nydegger

(57) ABSTRACT

A surf wax comb and holder usable as a surfboard accessory, wherein the comb is secured in a stowed position on the holder by a releasable connection and the holder with the comb stowed thereon is mountable to the top of a surfboard without penetration of the top layer of the board. The comb and holder present a thin, smooth surface that minimizes risk of injury to a surfer while proving the convenience of a readily available surf wax comb on the surfboard.

13 Claims, 7 Drawing Sheets

SURF WAX COMB AND HOLDER ACCESSORY

BACKGROUND

A. Field

This invention is a surf wax comb and holder having particular utility in the environment of surfboards and surfboard accessories.

B. Related Art and Problem to be Solved

Surf wax combs are used to roughen surf wax applied to the top of surfboards after the wax had been worn smooth by a surfer. The combs typically are small relatively rigid plastic flat sheets with teeth along one edge that are used to "comb" or roughen a wax coating that has been previously applied to the top side of a surfboard or to level bumps of wax built up on the board. Such combs are sold with or without the wax substance, and various forms of comb holders are available with wax containers, such as mounted on covers or packages of wax containers. The combs also may have a scraper edge along a rear and/or side edge of the combs.

A problem for surfers is avoiding loss of the surf wax combs, which are relatively small and easily misplaced or dropped in the sand of beaches where surfing is done, or otherwise simply forgotten at some place where the wax of the surfer's board was last combed. Even if the comb is kept in a pocket of a surfer (if a pocket is available) or on a tether attached to the surfer or the surfer's clothing, the likelihood of losing the comb is quite high and frequently occurs. The sharp comb teeth also present a danger of scratching or irritating the skin of a surfer when the comp is kept in a pocket or attached to the surfer as well.

Even if a comb is not actually lost, but is at a location remote from the location of the surfer, is may be inconvenient for the surfer to move to the location where the comb is located to retrieve the comb during surfing activity.

A solution to a lost or unavailable comb is to carry the comb on the surfboard, but this apparently has not been previously proposed. Such a comb carrying arrangement would enable the comb to be readily available to the surfer wherever the board was located, thereby avoiding loss of the comb or the need to walk to a remote location from the present location of the surfer to locate the comb. Ideally, the comb would be attached to the surfboard in a manner that would not require cutting into the surface of the board, which would weaken the board given the usual laminated construction of surfboards, and the comb could be sold as an original accessory mounted on a new surfboard or as an aftermarket accessory after the sale of the surfboard.

Ideally, the comb would not interfere with the function of the surfboard and would present no danger of bodily injury to a surfer either while carrying the board, paddling to a wave, riding a wave, wiping out or finishing at the shore. The comb also would need to be mounted in a secure manner given the often violent motion of the board during surfing activities. The comb preferably would be inexpensive to manufacture while providing all the benefits and advantages summarized above.

BRIEF SUMMARY OF THE DISCLOSURE

A surf wax comb and holder are described having particular advantages for use in a surfboard environment to keep the comb with the surfboard in a practical and convenient manner. The wax comb is configured to be usable in a normal manner for roughening or leveling a wax layer on the top side of a surfboard, and then stowed on the holder that is mounted on a top side of a surfboard preferably in a manner not penetrating the top layer or surface of the surfboard. The stowed comb on the holder preferably presents a smooth outer surface with little vertical projection or sharp edges above the top side of the surfboard and with the comb teeth shielded against contact with a surfer foot or body part.

The comb is secured to the holder by a releasable locking connection that keeps the comb with the holder until the user releases the connection. The connection preferably is engaged when the comb is moved onto the holder and the locking connection can be easily manipulated by the user to release the comb from the holder. The cost of manufacturing the comb and holder preferably is kept low by making the comb and holder in only two pieces from a suitable plastic material, although other materials are envisioned.

Thus, the surf wax comb and a holder as described herein effectively solves the surfer problem of lost or out of reach wax combs while providing a novel surfboard accessory.

DESCRIPTION OF THE DRAWINGS

With reference to the appended drawings showing preferred embodiments of the invention.

DETAILED DESCRIPTION OF PREFERRED EMBODIMENTS OF THE INVENTION

Figure 1:
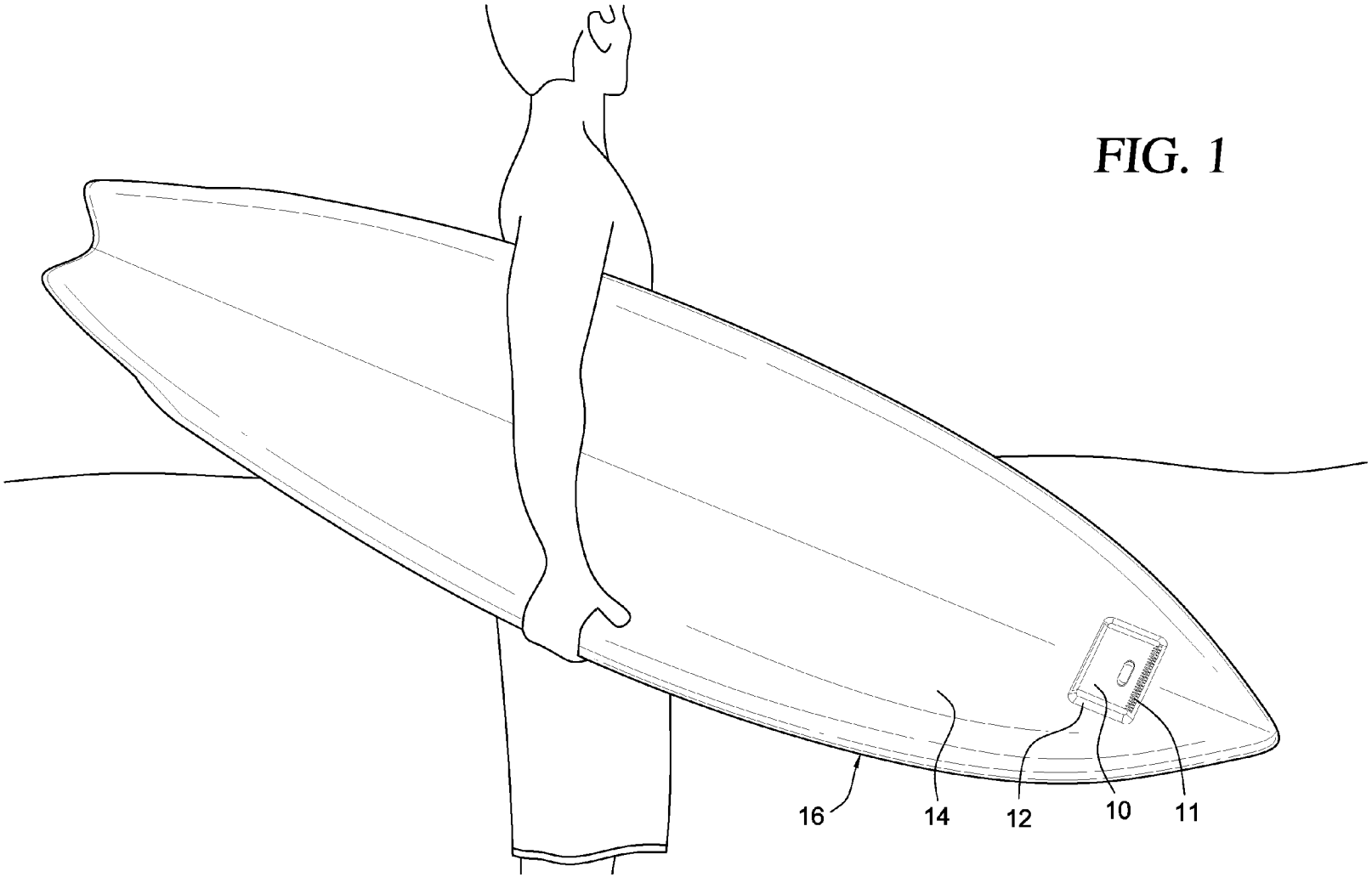
FIG. 1 is a side elevation view of a wax comb and holder embodiment of the present invention with the comb secured in a stowed position to the holder and the holder secured to an upper side of a surfboard away from a normal standing or riding position without penetrating the surface of the surfboard, the comb and holder presenting smooth flush upper surfaces.

With reference to the drawings, FIG. 1 shows a surf wax comb 10 in the preferred form of plate element having combing teeth 11 secured to a wax comb holder 12 in accordance with a preferred embodiment of the present invention. The holder 12 is shown secured to an upper side 14 of a surfboard 16 outside a standing or riding position on the surfboard, for example, as shown, at a forward upper side of the surfboard.

An objective of the invention is to provide a convenient carrying arrangement for a surf wax comb, which is notoriously easy to lose and problematic to stow during surfing activities. The surf wax comb, as is known, is used to roughen up or level wax applied to the upper side of a surfboard to provide a better grip for the feet of a surfer when riding a surfboard. Thus, fresh wax is only needed when the wax layer has been worn away to an extent that roughing the wax can no longer be done in a practical manner with acceptable results. While surf wax combs can be kept with a surfer's gear when not needed, surfers wish to keep a wax comb on or near their person and board so they can roughen of level the wax layer quickly on a moment's notice. Stowing the comb in one's pocket is possible, but not always practical, especially if the surfer's attire has no pockets or the pockets do not have a closure. Moreover, a relatively rigid surf comb in one's pocket could present the opportunity for skin injury during rigorous surfing.

In accordance with this embodiment of the invention, a surf wax comb 10 and holder 12 are configured to present a smooth upper surface when the comb is stowed in the holder so that when the holder is attached to the upper surface of an article or structure such as a surfboard 16, the comb and holder do not present an opportunity for injury in case of slippage of a surfer's foot or other body member or portion over the comb and holder. The comb 10 is stowed on the holder 12 so it will not separate unintentionally from the holder by a releasable detent lock arrangement to be described below, with a further securing arrangement between the comb and holder provided by upstanding sidewalls extending along opposed sides of the holder adjacent the comb retaining area of the holder, also to be described. The overall arrangement thus provides a convenient, safe carrying system for a surf wax comb that can be offered as a practical accessory for a surfboard.

Figure 3:
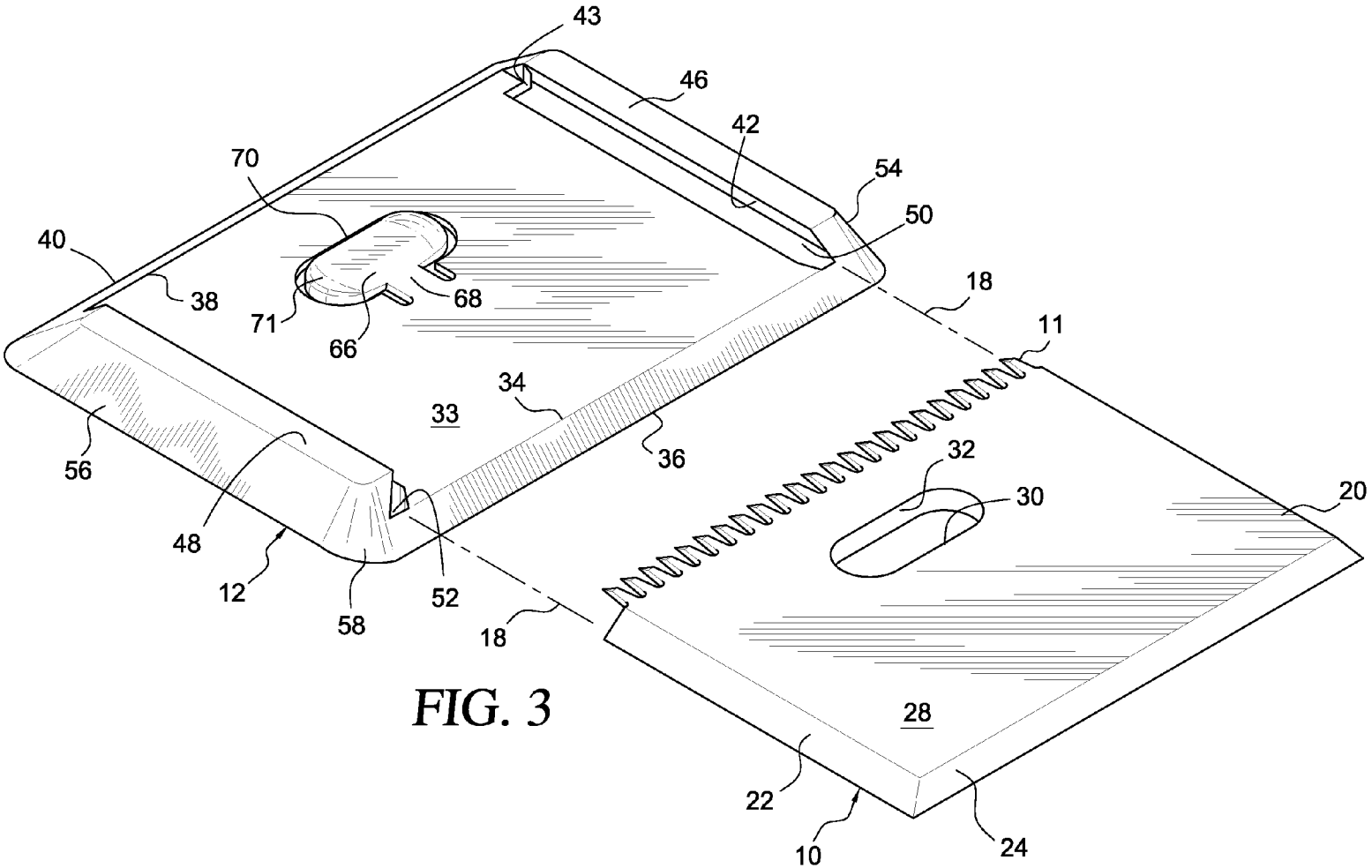
FIG. 3 is a blown up perspective view of the wax comb and holder shown in FIG. 1 illustrating how the comb is assembled to the holder for stowing.

The surf wax comb and holder shown in FIG. 1 are shown in FIG. 3 with the comb 10 separated from the holder 12, with dash lines 18 indicating the path taken by the comb 10 as it is moved toward a stowed position on the holder 12. Specifically, the comb 10, here shown as a generally rectangular comb formed, for example, of a plastic material, has lateral side edges 20, 22, a front edge with the combing teeth 11, a rear edge 24, and a generally planar bottom side 26 not visible in FIG. 3, but shown in FIG. 4, and an upper side 28. The side edges 20, 22 in this embodiment are sloped or inclined inwardly and upwardly, as shown.

The side edges 20, 22 of the comb 10 in this embodiment are angled inwardly from the bottom of the comb 26 towards the upper side 28 for reasons to become evident later when the connection between the side edges and the holder 12 is described.

The comb 10 also is provided with an aperture 30 extending through the thickness of the comb and bounded by an aperture sidewall 32. The shape of the aperture 30 in this embodiment is oblong, but the form of the aperture could be varied to suit its function and the manner in which it cooperates with the detent lock on the holder that secures the comb to the holder against horizontal relative movement in the stowed position, to be described next.

The holder 12 comprises a base plate formed preferably of a suitable plastic material and having a generally planar central surface area 33 that in this embodiment extends from the upper portion 34 of the rear edge 36 of the holder 12 to the upper portion 38 of the front edge 40 of the holder, and also laterally between a pair of opposed upstanding sidewalls 42, 44 that extend upwardly from a plane including the upper surface area 33 to an upper end terminating at planar upper surfaces 46, 48. Each sidewall terminates at a forward or front end at an abutment 43. For convenience in molding and forming the holder 12 as a single piece, and to provide for the abutments 43 at the ends of the sidewalls 42, 44, side openings 50, 52 are located along the bottom edges of the sidewalls 42, 44, respectively. The openings also may function to keep the sidewall areas clear of sand and other debris that could interfere with the sliding motion of the comb into the holder when stowing the comb as well.

The holder 12 also has lateral side edges 54, 56, which, with the front and rear edges 36 and 40, and the connecting corner areas 58, define an outer periphery of the holder 12. The holder 12 also has a bottom side 60 (see FIG. 5), that includes a recess 62 bounded by a peripheral sidewall 64 so that the bottom of the recess is above (recessed within) the bottom level of the sidewall 64 to provide a space for a sheet connector element to be described below and to permit downward movement of the detent locking member to be described below. The bottom side of the sidewall 64 provides a support area for the holder 12 when the holder is secured to a structure or member such as a surfboard.

Figure 4:
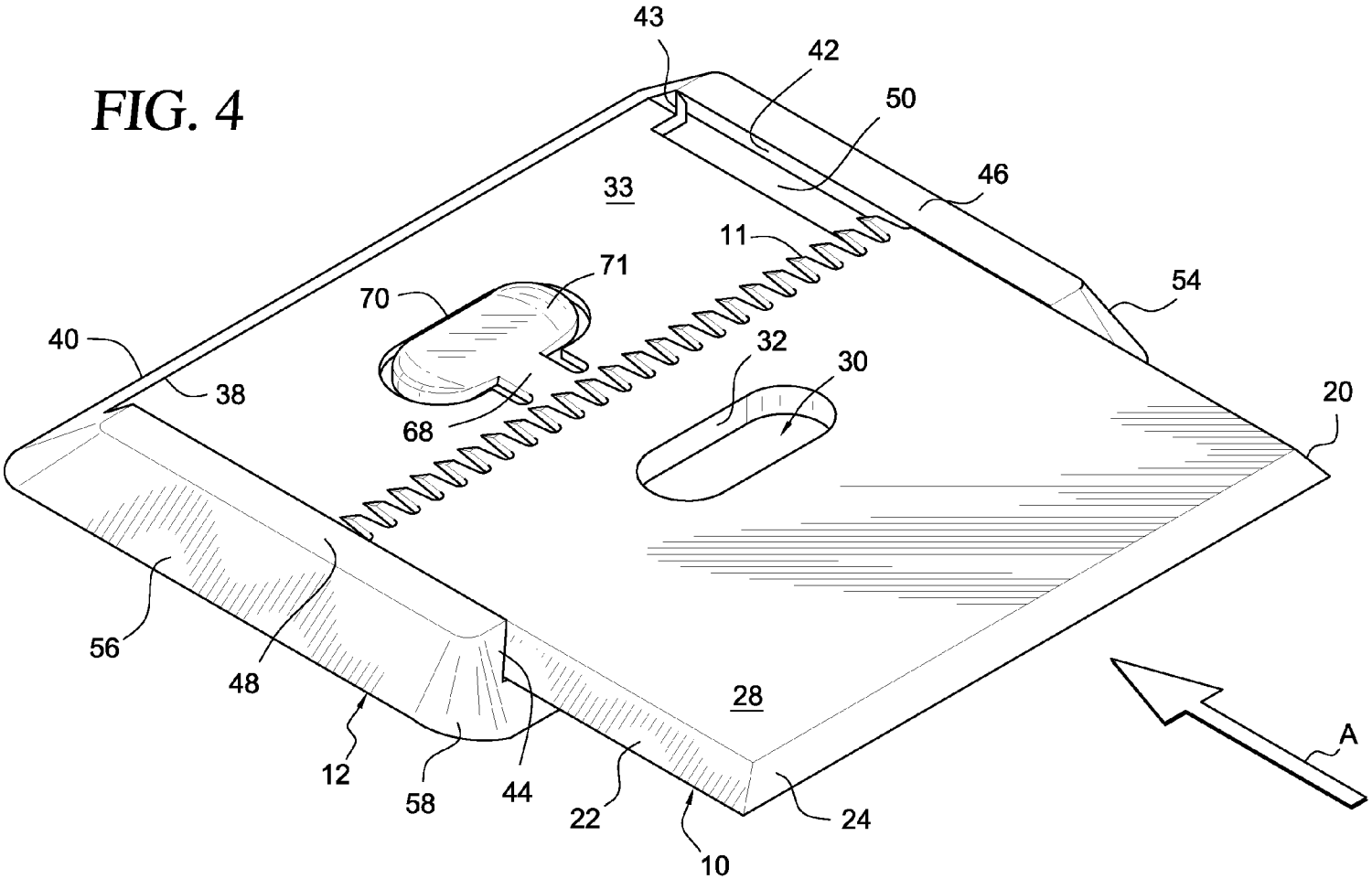
FIG. 4 is a perspective view showing the wax comb and holder of FIG. 3 with the comb partially stowed on the holder.

The upstanding sidewalls 42, 44 are inclined inwardly from the level of the planar surface area 33 towards their upper ends, in this embodiment with a slope of inclination matching the slope of inclination of the side edges 20, 22 of the comb, so that the side edges 20, 22 engage the upstanding sidewalls 42, 44 in a dovetail locking configuration that enables the comb to be slid onto the planar surface area 33 of the holder in the direction of arrow A in FIG. 4 (referred also as the "forward" direction herein) for stowage and secured in such stowed position against upward relative movement that would cause separation of the comb from the holder in a direction perpendicular to the planar surface area 33. The abutments 43 limit the forward movement of the comb as it is slid onto the holder surface 33 by engaging the front ends of the side edges 20, 22 of the comb 10.

A locking detent member 66 is integrally formed by a portion of the holder in the central planar surface area that is separated from the holder material defining the planar surface area between the upper surface thereof and the bottom (or upper side if viewed as in FIGS. 6 and 7) of the recess 60, but connected thereto by a bridge of holder material 68 that is smaller than the periphery of the detent member 66, which is cut away from the surrounding holder material.

The bridge of holder material 68 is resilient due to the inherent resiliency of the holder material at the bridge and enables the detent member 66 to be moved downwardly by manipulation relative to the planar surface area 33 while the normal position of the detent member 66 is such that a front portion 70 of the detent extends above the planar surface area 33 for reasons to be explained below.

The bridge 68 may be manually bent by pressing down on the detent 66 from above and upon release of the detent 66, the detent 66 will return to its original position as shown with at least a portion 70 at the forward end and part of the upwardly curved side portions 71 of the detent extending above the planar surface area 33. The rearward end of the detent 66 at the connection with the bridge 68 is located in substantially the same plane as the planar surface 33. The natural inherent elastic resiliency of the holder material acts as a bias when the detent member 66 is moved downwardly with the resulting elastic bending of the bridge 68 tending to return the detent member to its initial starting position.

Figure 6:
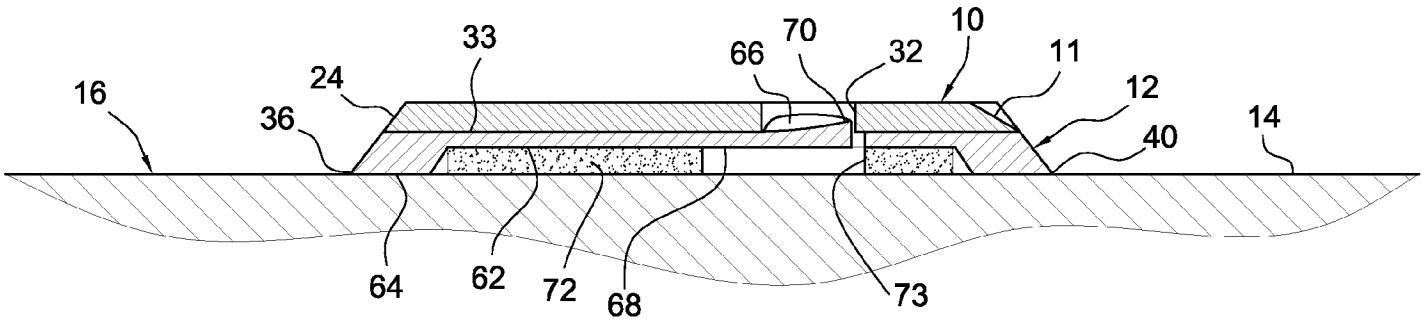
FIGS. 6 and 7 are respectively section views taken along lines 6-6 and 7-7 in FIG. 2 showing the details of the comb locking arrangement securing the comb to the holder in the stowed position.
Figure 7:
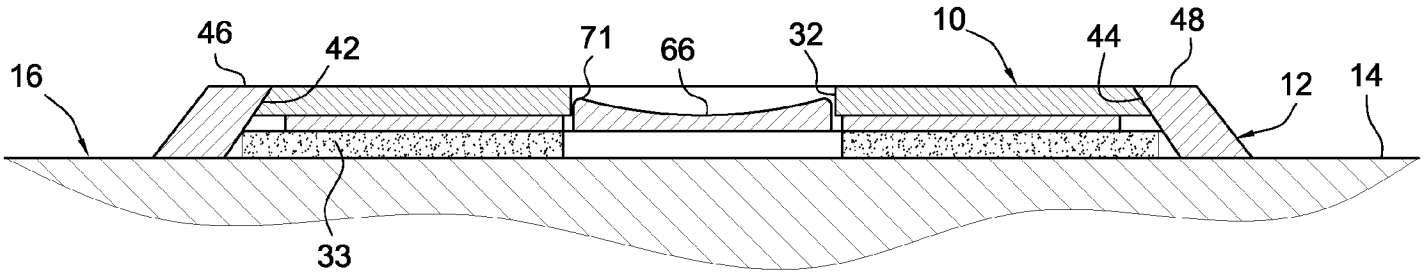

FIGS. 6 and 7 best illustrate the relative positions of the comb 10, the holder 12, the detent lock member 66, the detent portions 70 and 71 and the sidewall 32 of aperture 30 in the comb 10 when the comb 10 is in the stowed position in the holder 12. The comb at this stage has been inserted between the sidewalls 42, 44 in the forward direction (arrow A in FIG. 4) by engagement of the side edges 20, 22 of the comb 10 with the upstanding sidewalls 42, 44, respectively with a forward sliding movement as can be deduced from FIG. 3. The bottom 26 of the comb in this position rests on the planar surface 33 of the holder, and the aperture 30 becomes aligned with the detent 66 so that the detent lock 66 projects upwardly at its front portion 70 into the aperture 30 as shown to provide a positive mechanical locking connection between the comb and the holder. In this position, the detent front portion 70 cooperates with the front side of sidewall 32 of the aperture to prevent relative movement between the comb 10 and the holder 12 in a direction parallel with the planar surface 33 in a direction rearwardly (to the right as viewed in FIG. 4. The dovetail connection between the side edges 20, 22 and the sidewalls 42, 44 respectively prevents movement of the comb 10 relative to the holder 12 in a vertical or upward direction, thereby preventing separation of the comb 10 from the holder 12 in that direction. The abutments 43 at the front ends of the upstanding sidewalls 42, 44 prevent forward movement of the comb 10 relative to holder 12 when the comb is in the stowed position, with the detent member engaged with the aperture sidewall 32.

Thus, the comb 10 in its stowed position as shown in FIGS. 6 and 7 is securely retained on the holder until the detent member 66 is engaged manually through the aperture 30 and is pressed downwardly until the detent portion 70 that cooperates with the aperture sidewall 32 is below the sidewall 32 to thereby release the comb 12 for sliding movement rearwardly along the planar surface 33 until the dovetail connection is separated, at which point the comb 10 may be separated from the holder 12 for use by a surfer.

Return of the comb 10 to its stowed position again involves a reverse of the release procedure, except that sliding the comb onto the planar surface area 33 to stow the comb with the dovetail connection engaged along the comb side edges will deflect the detent 66 down as the comb bottom 26 presses down on the upwardly curved side portions 71 of the detent lock 66 when passing over the detent lock during the stowing procedure, and then the detent 66 will spring back to its starting position in the aperture 30 when the aperture becomes aligned with the detent 66 to secure the comb 10 against separation from the holder 12, as clearly shown in FIGS. 6 and 7. The gradual upward and forward slope of the side portions 71 of the detent 66 enables a smooth camming action between the bottom 26 of the comb and the detent side portions 71 to cause the detent to be pressed down as the bottom 26 of the comb passes over the side portions 71 to enable the comb to be moved to its fully stowed position.

Figure 2:
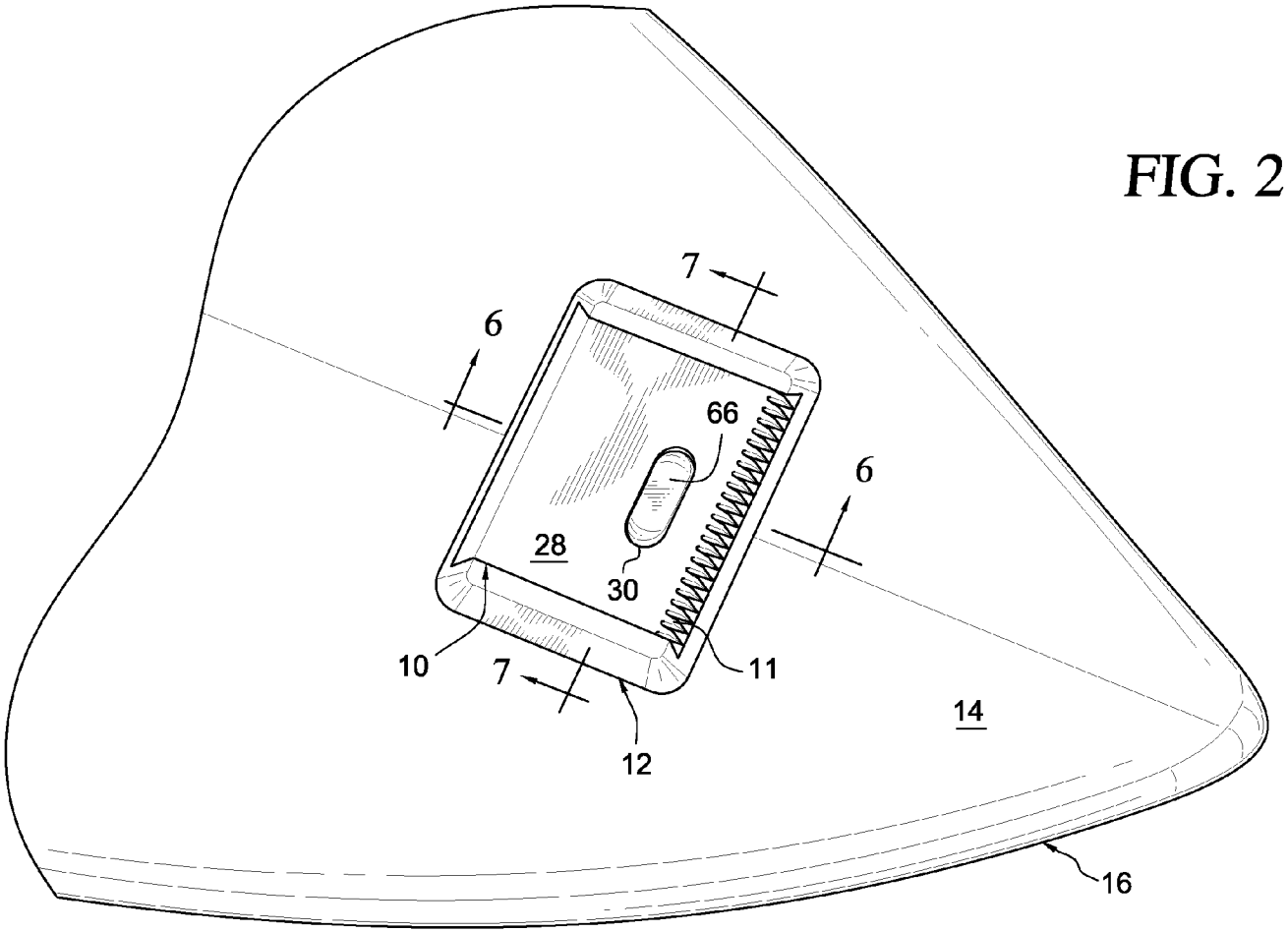
FIG. 2 is an enlarged perspective view of the wax comb and holder shown in FIG. 1.

All four sides of the holder base plate 12 are slanted inwardly from the bottom side of the holder base plate to the tops of the rear, front, and side edges 36, 40, 54, 56 of the holder base plate and the rear edge 24 of the comb 10 is slanted inwardly at the same angle of inclination as the rear edge 36 of the holder base plate, so that when the comb 10 is in the stowed position, as seen in FIGS. 2, 6 and 7 the rear edge of the holder base plate and the rear edge of the comb flow smoothly into each other in a smooth upward and inwardly slanted rear edge of the combined holder and comb and the four sides of the combined holder and comb present upwardly and inwardly slanted sides that avoid vertical edges around the comb and holder so that in case of contact between a body member such as a foot, belly or hand and the stowed comb on the holder, the risk of injury is minimized. In this regard, the top sides of the teeth 11 likewise are slanted down at an angle to match the angle of slope of the front edge 40 of the holder base plate to avoid any vertical sharp edges along the tops of the teeth as shown in FIG. 6.

The height of the upstanding sidewalls 42, 44 is selected such that they match the thickness of the comb 10, so that when stowed, the comb top surface 28 is flush with the top sides 46, 48 of the side edges of the holder base plate 12, as shown in FIGS. 6 and 7. The length of the comb is selected so that the wax combing teeth are substantially aligned with the top of the front edge of the holder base plate 12, as shown in FIG. 6 when the comb is in the stowed position and the rear edge 24 of the comb is flush with the upper side 34 of the rear edge 36 of the holder base plate, as shown in FIG. 6.

Figure 5:
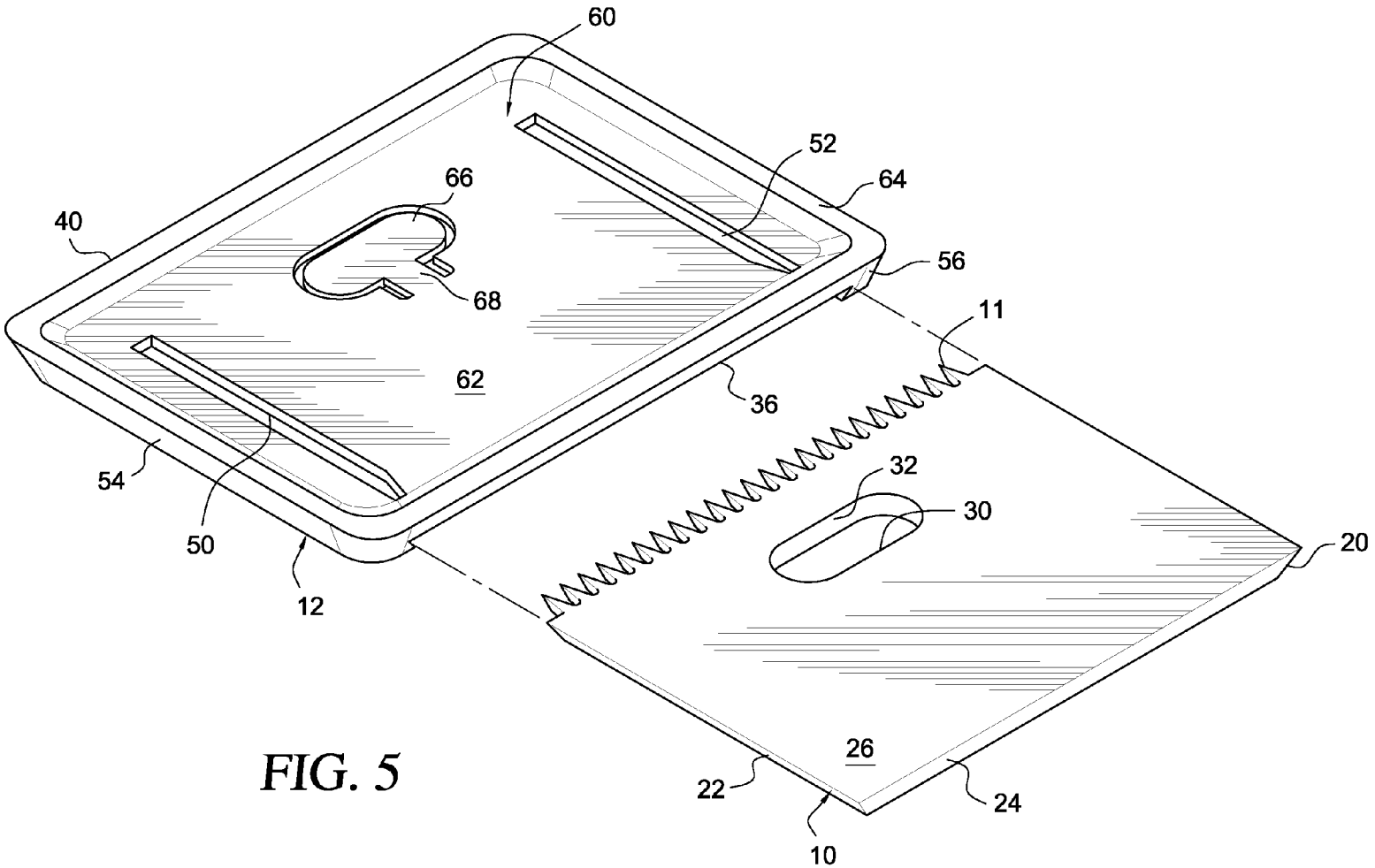
FIG. 5 is a perspective view taken from below the wax comb and holder shown in FIG. 3.

A sheet bonding element 72 such as double sided adhesive tape, hook and loop fabric (e.g., Velcro) or the like is adhered on its upper side to the bottom of the recess 62 (when viewed in the inverted position as seen in FIG. 5) and may have a protective layer (not shown) on the outer lower side thereof that may be removed prior to the sheet bonding element being used to adhere or attach the holder base plate 12 to a structure or article such a surfboard 16, as shown in FIGS. 6 and 7. When the holder base plate is so attached to a structure or article, the bottom of the periphery 64 will closely adjoin the surface to which the holder is attached, as shown in FIGS. 6 and 7. An opening 73 in the sheet bonding element 72 prevents contact between the sheet bonding element and the bottom of the detent lock 66 and avoids interference with the detent lock movement.

While a sheet bonding element is shown as an exemplary manner of bonding the holder base plate to a structure such as a surfboard, as an alternative arrangement, an adhesive or a bonding sheet could be applied to the bottom surface 64 of the periphery of the bottom side of the holder 12 for the purpose of bonding the holder base plate to a surface. A bonding material such as an adhesive also could be used between the recess 60 and the structure or surfboard, with appropriate measures taken to distribute the adhesive in a manner that will not interfere with the movement and action of the detent 66. Preferably, when a surfboard is the structure to which the holder base plate is attached, the surfboard structure is not penetrated by a fastener device to avoid compromise of the structural integrity of the surfboard. For other applications, a permanent or releasable fastener device could be used to connect the holder base plate to a structure if such fastening is desired.

Figures 8, 9:
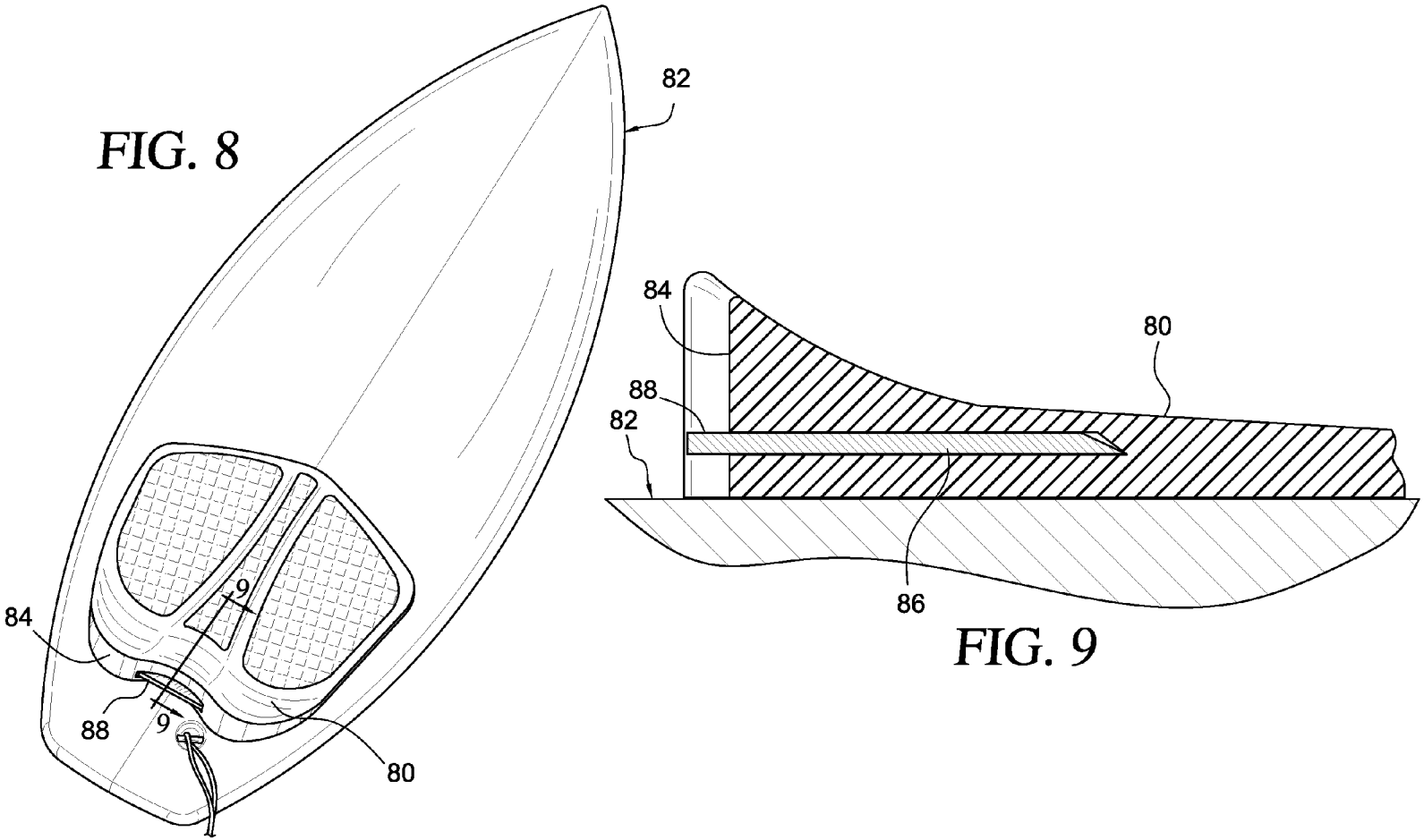
FIG. 8 is an upper perspective view of an alternate embodiment of the wax comb and holder of this invention in the environment of a surfboard accessory that functions as a wax comb holder.
FIG. 9 is a section view taken along line 9-9 in FIG. 6 showing how the wax comb fits frictionally within a surfboard accessory that constitutes a wax comb holder.

An alternate form of a comb and holder according to the present invention is shown in FIGS. 8 and 9, wherein a surfer foot rest 80 is bonded or otherwise attached to the top rearward side of a surfboard 82. Such footrests are marketed as a surfboard accessory, and may be sold in one or more pieces that can be custom fitted to a surfboard to provide a foothold for a surfer's rear foot during surfing. The rear edge area 84 of the foot rest has a thickness and a slit or slot 86 is cut into the material of the foot rest as shown in FIG. 9 from the rear edge towards the front of the surfboard in this embodiment. The slit or slot accommodates a surf wax comb 88 as shown in FIG. 8. The slit or slot 86 extends within the thickness of the material between the top and bottom of the footrest without intersecting the top or bottom, and the length of the slit or slot is less than the total length of the comb 88 so that a small area of the comb will protrude rearward from the slit or slot to provide a grasping area for manipulation of the comb into and out of the slit or slot. The height of the slit or slot also is selected so that comb will fit into the slit or slot in close fitting relationship to provide a friction force holding the comb in the slit or slot until the comb is pulled out by a surfer when access to the comb is desired. In practice, an interference fit is desired between the comb and the material defining the slit or slot, which is assumed to be somewhat resilient, such as a foam material or a material having deformable elastomeric properties.

The above descriptions of two forms or embodiments of the surf wax comb and holder are exemplary only, and various other configurations of comb and holder capable of performing the desired function of stowing a comb on a holder for a surfboard or other article accessory can be readily envisioned without departing from the spirit and scope of the inventive concept described and claimed herein. For example, the holder can be made of a material other than plastic, provided it can withstand the environment in which a surfboard is carried and used. The comb likewise can be made of any suitable material other than plastic, although plastic is preferred. The dovetail connection along the upstanding sidewalls along the side edges of the central planar area of the holder base plate could be an "L" shaped undercut instead of a dovetail, with the side edges of the comb undercut in a form that will cooperate in a mating relationship with the upstanding "L" shaped sidewalls or the comb edges could be flat to fit within the "L" shaped undercut. In fact, any suitable connection can be used for the upstanding sidewalls on either side of the planar area to secure the comb side edges against separation in a vertical direction away from the planar area and to limit forward motion of the comb in the stowed position when the detent lock engages the comb aperture. The dovetail is a preferred form because it is forgiving of manufacturing tolerances, as the slanted interface between the sidewalls and the comb side edges inherently tends to hold the comb close to the planar surface of the holder base plate, particularly when the comb fits snugly within the upstanding side walls.

The form of the locking detent can be varied without departing from the inventive concept disclosed herein. Any form of detent that permits sliding of the comb over the detent during movement towards the stowed position and prevents unintentional sliding of the comb back out of the holder base plate can be used, provided that there is a bias or mechanism of some kind holding the detent in its locking position during use, and which can be overcome or manipulated by moving the detent downward out of the aperture in the comb by pressing the detent down through the aperture. The angle and form of the sloping rear, side and front edges of the comb and holder can be varied for various applications and to suit different markets in which the comb and holder will be sold and used. The slanted form illustrated is preferred for surfboard applications to present a smooth edge shape that will avoid injury or abrasion to a surfer. The front, rear and side edges, however, could be curved or rounded along their top sides for a different aesthetic look or effect. Decoration or advertisement could be applied to the comb and holder as well.

While the holder base plate and the comb plate are shown as rectangular, the comb could be arcuate along its side edges and the upstanding sidewalls of the holder base plate could have complementary arcuate curvatures that would permit the side edges of the comb base plate to fit snugly within the upstanding side edges as the comb is advanced into its stowed position.

The configuration of the bottom of the holder base plate 12 also can be varied to accommodate the structure or surfboard to which is to be attached. The bottom periphery edge 64 could be curved or flat, and the recess could be omitted if desired if a small gap under the holder base plate can be tolerated, assuming a sheet bonding element is used between the holder base plate and the surface to which the plate is attached. The recess also could be configured in any desired manner, such as grooves or discontinuous recesses on the bottom of the holder base plate.

The abutments 43 at the forward ends of the dovetail connections provided by the upstanding sidewalls 42, 44 is a preferred embodiment of a motion stop arrangement to limit the forward movement of the comb 10 on the holder base plate 12 when the comb is moved to its stowed position on the holder, but any suitable stop could be envisioned to limit the comb motion, such as, for example, a stop element on the front end of the planar surface 33 that would engage the comb as it reaches its stowed position.

What is claimed:

1. A wax comb and holder comprising: a holder base plate having a periphery, an upper generally planar surface area and a pair of laterally upstanding, longitudinally extending sidewall portions extending along two opposed sides of the planar surface area, said planar surface area and sidewall portions being located within the base plate periphery; a locking detent formed integrally in one piece with the base plate and having a detent portion normally extending upwardly above the planar surface area, the detent arranged to be manually movable downwardly to lower the detent portion relative to the planar surface area; a resilient bias arrangement tending to maintain the detent portion normally extending above the planar area and to return same to such position upon movement of the portion in a downward direction; a comb comprising a comb plate having a generally flat bottom side, comb teeth extending along a front edge thereof, side edges and a rear edge; said comb side edges configured and dimensioned so that the side edges fit in close relationship between the laterally upstanding sidewall portions of the base plate when the comb plate is disposed in a stowed position with the bottom side thereof located atop the upper planar surface area of the base plate with the side edges engaging the sidewall portions and with the comb plate disposed within the periphery of the base plate; said base plate sidewall portions and said comb plate side edges configured so they positively engage each other in manner preventing separation of the comb and base plate in an upward direction that would cause the comb to separate from the base plate in a direction perpendicular to the planar area; said comb plate having an aperture located theron such that when the comb plate is disposed on the base plate in a stowed position during use with the comb plate bottom side disposed atop the base plate planar surface area and the comb side edges engaged with the base plate sidewall portions, the aperture is aligned with the locking detent portion that extends above the base plate planar area and at least part of the detent portion extends within the aperture of the comb plate; said detent portion and aperture configured so that with the at least part of the detent portion extending within said aperture, cooperation between aperture edges defining the aperture and the detent portion prevents movement of the stowed comb plate at least in a direction parallel to the base plate planar area and parallel with the sidewalls and in a rearward direction by engagement between the aperture edges and the detent portion; a forward movement preventing device adapted to prevent forward movement of the comb plate relative to the base plate when the comb plate is in a stowed position on the base plate with the detent portion cooperating with the comb plate aperture; said comb plate being releasable for movement parallel to the base plate planar surface area in a rearward direction by manipulation of the detent portion through the aperture to cause movement of the detent portion in a downward direction to disengage the detent portion from the aperture edges.

2. The wax comb and holder according to claim 1, said upstanding sidewall portions and comb plate side edges configured as cooperating dovetail elements that permit relative sliding movement of the comb plate along and between the sidewall portions but not upward or transverse movement of the comb plate relative to the sidewall portions.

3. The wax comb and holder according to claim 1, wherein said resilient bias arrangement is provided by an inherent resiliency of the base plate material, said detent portion connected to the base plate by a bridge section of the base plate material having a cross section area that is reduced in size relative to a perimeter of the detent portion that is not connected to the base plate.

4. The wax comb and holder according to claim 1, said base plate having a bottom side having a recess within said base plate periphery that will accommodate a sheet bonding element usable to secure the base plate to an article or structure surface with at least a portion of a peripheral area of the bottom side in contact with or closely adjacent the surface.

5. The wax comb and holder according to claim 1, said comb plate and said sidewall portions having upper sides, wherein said comb plate has a thickness dimension such that when the comb plate side edges are engaged with the sidewall portions, the comb plate and sidewall upper sides are flush with each other.

6. The wax comb and holder according to claim 5, said comb plate and said base plate being dimensioned such that when the comb plate is disposed in the stowed position with the detent portion within the aperture of the comb plate, the front and rear edges of the comb plate coextend substantially with adjoining front and upper rear edges of the base plate and the combing teeth do not protrude beyond the base plate upper front edge.

7. The wax comb and holder according to claim 6, said front and rear edges of the base plate sloping inwardly from a bottom area toward an upper area thereof; said base plate having side edges adjacent said upstanding sidewall portions that slope inwardly from a bottom area toward an upper area thereof; said comb plate rear edge sloping inwardly from a bottom area toward an upper area thereof; the angle of slope of the base plate and comb plate rear edges being equal to each other and the angle of slope of the base plate rear edge being equal to the angle of slope of the base plate side edges.

8. A surf board arrangement, comprising a surfboard, the wax comb and holder of any one of claims 1-7, and a sheet bonding element, wherein the sheet bonding element is attached both to a bottom side of the base plate and the upper surface area of the surfboard without penetration of the surfboard upper surface area to provide a secure connection between the base plate and the upper surface area of the surfboard.

9. A surfboard arrangement, comprising a surfboard having an upper surface area; a wax comb holder secured to the upper surface area by a sheet bonding element that is attached to both the upper surface and a bottom surface of the holder without penetrating the upper surface; a wax comb having comb teeth along at least one edge thereof, said wax comb mounted to the holder in a stowed position and secured thereto by a releasable mechanical connection that positively prevents movement of the wax comb relative to the holder that would cause separation of the wax comb from the holder when the wax comb is in the stowed position, but which is manually releasable to permit separation of the comb from the holder.

10. The surfboard arrangement according to claim 9, said wax comb holder having upstanding opposed side edges between which the wax comb is located, said wax comb and side edges having upper surfaces flush with each other when the wax comb is stowed on the holder; said wax comb holder having a periphery defined by front, side and rear edges; said wax comb fitting within the wax comb holder periphery when stowed on the holder.

11. The surfboard arrangement according to claim 9, said sheet bonding element comprising a double faced adhesive sheet.

12. The surfboard arrangement according to claim 11, said holder having a bottom side with a recess, said adhesive sheet disposed in said recess so that the bottom side of the holder beyond the recess is closely adjacent the surfboard upper surface.

13. The surfboard arrangement according to claim 10, said wax comb attached to the holder along side edges of the comb by a dovetail connection between the comb side edges and the upstanding opposed side edges, said dovetail connection permitting only sliding movement of the comb relative to the holder in a direction along the sidewalls when the wax comb is in the stowed position; said releasable connection preventing such sliding movement between the comb and holder that would release the comb from the holder when the comb is in the stowed position until the releasable connection is manipulated to a release position.

* * * * *